US007370480B1

(12) United States Patent
Balzano

(10) Patent No.: US 7,370,480 B1
(45) Date of Patent: May 13, 2008

(54) SOLID STATE THERMAL APPARATUS

(76) Inventor: Alfiero Balzano, 11371 Monarch St., Garden Grove, CA (US) 92841

( * ) Notice: Subject to any disclaimer, the term of this patent is extended or adjusted under 35 U.S.C. 154(b) by 657 days.

(21) Appl. No.: 10/728,153

(22) Filed: Dec. 4, 2003

Related U.S. Application Data

(60) Provisional application No. 60/431,778, filed on Dec. 9, 2002.

(51) Int. Cl.
*F28F 7/00* (2006.01)
*F25B 21/02* (2006.01)

(52) U.S. Cl. ..... 62/3.7; 361/704; 165/185

(58) Field of Classification Search ..... 165/185; 174/252; 361/704, 719; 62/3.1, 3.2, 3.7
See application file for complete search history.

(56) References Cited

U.S. PATENT DOCUMENTS

| | | | | |
|---|---|---|---|---|
| 3,073,974 | A * | 1/1963 | Hoh | 62/3.1 |
| 3,509,429 | A * | 4/1970 | Crowe et al. | 257/712 |
| 5,448,891 | A * | 9/1995 | Nakagiri et al. | 62/3.4 |
| 5,588,300 | A * | 12/1996 | Larsson et al. | 62/3.61 |
| 5,704,212 | A * | 1/1998 | Erler et al. | 62/3.2 |
| 6,173,576 | B1 * | 1/2001 | Ishida et al. | 62/3.7 |
| 6,233,149 | B1 * | 5/2001 | Bailey et al. | 361/704 |
| 6,257,329 | B1 * | 7/2001 | Balzano | 165/185 |
| 6,508,595 | B1 * | 1/2003 | Chan et al. | 385/92 |
| 6,587,346 | B1 * | 7/2003 | Parker | 361/719 |
| 6,591,615 | B1 * | 7/2003 | Luo | 62/3.7 |
| 6,779,347 | B2 * | 8/2004 | Kucherov et al. | 62/3.1 |
| 6,920,046 | B2 * | 7/2005 | Spryshak | 361/704 |
| 6,948,322 | B1 * | 9/2005 | Giblin | 62/3.5 |
| 7,109,408 | B2 * | 9/2006 | Kucherov et al. | 136/205 |
| 2003/0033818 | A1 * | 2/2003 | Kucherov et al. | 62/3.1 |
| 2003/0126866 | A1 * | 7/2003 | Spry | 62/3.7 |
| 2003/0183368 | A1 * | 10/2003 | Paradis et al. | 165/80.3 |
| 2004/0055312 | A1 * | 3/2004 | Bell | 62/3.7 |
| 2004/0264141 | A1 * | 12/2004 | Spryshak | 361/719 |
| 2005/0091988 | A1 * | 5/2005 | Stewart et al. | 62/3.1 |
| 2005/0161072 | A1 * | 7/2005 | Esser et al. | 136/205 |
| 2005/0274119 | A1 * | 12/2005 | Lee | 62/3.7 |

* cited by examiner

*Primary Examiner*—William C Doerrler
(74) *Attorney, Agent, or Firm*—Stetina Brunda Garred & Brucker

(57) ABSTRACT

A solid state thermal device for conducting heat from a source and transferring the heat to an exhaust tunnel or converter for controlling the current flow passing through the solid state device. The device includes a plurality of diode arrays which interface between heat conductors and an exhaust tunnel, The device includes a thermal cable connected at one end to the heat source and connected at its other end to an interface of solid state devices, such as a diode array. Conductance of the heat to the interface diode array is via a graphite heat conducting composite material conducting heat at least five times the rate of copper. A thermal conversion unit is coupled to the diode interfacing arrays that controllably transfers the heat for introduction into a plurality of graphite composition stages or members, which are included in the unit. A blower is provided in the tunnel for forcibly conducting the heat radiated from the graphite composition members. The diode array interface removes a small amount of heat and then conducts it to the next array, thereby pulling the heat away from the heat source. The graphite material is directional in thermal conduction, and the blower utilizes convection to blow heat through the tunnel.

16 Claims, 1 Drawing Sheet

HEAT SOURCE
CONDUCTOR
POWER SOURCE
11
12
13
14
15
16
17
18
20
21
26
27
10

13
14
15
18
20
21
23
24
25
26
27
13'

12
13
15
20
26
27
30
31
32
33
34
P
N

SOLID STATE THERMAL APPARATUS

This application claims benefit of application Ser. No. 60/431,778 filed Dec. 09, 2002.

BACKGROUND OF THE INVENTION

1. Field of the Invention

The present invention relates to the field of thermal devices, and more particularly to a novel, highly efficient, thermal handling device capable of conducting thermal energy from a heat source, such as a refrigeration unit, to a dissipating means or to a means that can utilize the heat byproduct generated by the source.

2. Description of the Prior Art

In the past, it has been the conventional practice to cool a heat source, such as in a refrigeration unit, by employing a liquid conversion system utilizing the evaporation of a heat absorbing liquid or refrigerant. The refrigerant may take the form of Freon, ammonia or other gas presently used in conventional refrigeration. In such a system, a compressor is employed to initially compress refrigerant gas, thereby raising the liquid's pressure and temperature. The high cost of pumping refrigerant through the compressor and the use of a compressor, per se, is a requirement that needs to be eliminated. Conventional refrigeration systems employ heat exchanging copper coils placed externally of the refrigerator allowing the refrigerant to dissipate the heat. Also, the conventional use of copper tubing presents a weight problem. As the refrigerant cools, it condenses into liquid form and moves from a high pressure zone to a low pressure zone, thereby expanding and evaporating. In evaporating, the refrigerant absorbs heat, thereby cooling the heat source. This process recycles and each cycle removes a small amount of heat from the heat source.

Additional problems and difficulties have been encountered when using conventional thermal conversion and dissipating means which stem largely from the fact that the dissipated heat is lost and is not employed for any other purposes. Also, other problems have been encountered, such as the cost of running refrigerant through the compressor, the weight of the copper used, and the high amount of electrical current needed to run the conventional refrigeration system. Additionally, the temperature of conventional refrigeration systems is not finitely controlled.

Therefore, a long-standing need has existed to provide a novel solid state thermal apparatus which includes a thermal management system that is made up of a heat conductor or carrier composed of a graphite composition capable of rapidly conducting thermal energy and which can transfer heat from a heat source to an area where the transferred heat is either dissipated, stored, or used for alternate useful purposes. The solid state apparatus includes components made up of the graphite composition or substance, and further employs a multiple diode array for creating an interface between the heat source and an exchanger or conversion unit which forcibly conducts the heat away from the heat source.

SUMMARY OF THE INVENTION

Accordingly, the above problems and difficulties are avoided by the present invention which provides a solid state thermal device for conducting thermal energy away from a heat source and transferring the heat to an exhaust tunnel or converter including means for controlling the flow of electrons or current passing through the solid state device. Such a solid state device may take the form of a plurality of diode arrays which interface between the heat conductors and the exhaust tunnel, conduit or converter.

The thermal device further includes a thermal cable connected at one end to the heat source and connected at its other end to an interface of solid state devices, such as a diode array. Conductance of the heat to the interface diode array is via a graphite heat conducting material, which conducts heat at least five times the rate of copper. A thermal transporting or conversion unit is coupled to the diode interfacing arrays that controllably transfers the heat for introduction into a plurality of graphite composition stages or members, which are included in the unit. A fan or other blower means is provided in the tunnel or conduit for forcibly conducting the heat radiated from the graphite composition members. A small amount of heat subsequently in the diode array interface is removed and then conducted to the next array, thereby pulling the heat away from the heat source. The graphite material members are directional in thermal conduction, and the fan or blower utilizes convection to blow heat through the tunnel or the conversion unit.

Therefore, it is among the primary objects of the present invention to provide a high thermal conductivity device for providing thermal cooling for high speed electronic data processors on a continuous basis.

Another object is to provide a high thermal conductivity apparatus for a regulated, low cost, low energy, refrigeration process for food or other product storage.

Still another object of the present invention is to provide a solid state thermal conduction apparatus which is finitely controllable by regulating the power to a thermal semiconductor interface in combination with a blower means that can also be finitely regulated by the amount of power provided to it.

Still another object resides in providing a solid state thermal management system incorporating significantly lower current requirements than is conventionally needed to power conventional refrigeration systems.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

DESCRIPTION OF PREFERRED EMBODIMENT

Figure 1:
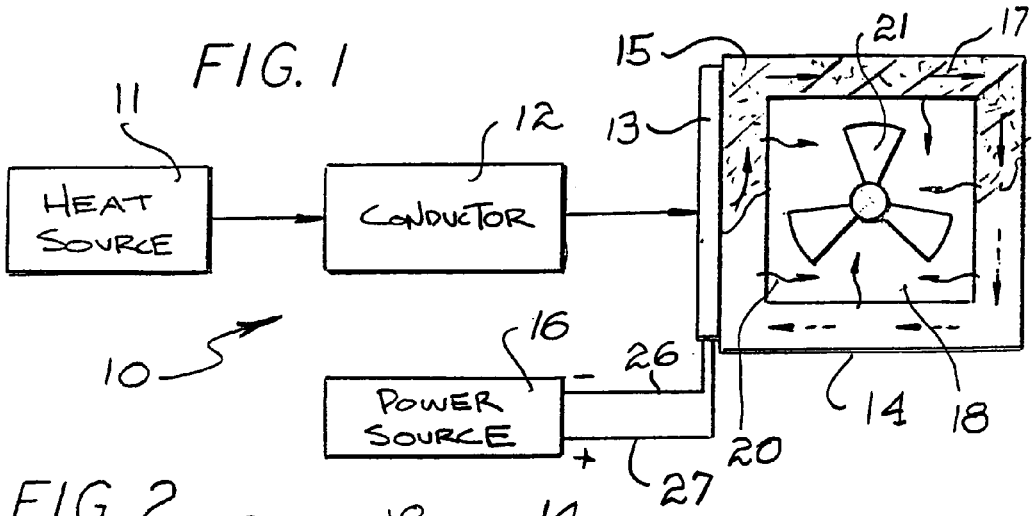
FIG. 1 is a block diagram illustrating the general system employing solid state devices and incorporating the present invention.

Referring now in detail to FIG. 1, a heat source 11 which may be available in such equipment as refrigerators or the like, is illustrated. The heat source 11 is connected to a solid state interface 13 by means of a thermal conductor 12. The thermal conductor may take the form of a compressed and heat treated graphite composite material, arranged in an array of parallel runs or tracks along a flexible cable, such as described in U.S. Pat. No. 6,257,329. The solid state interface 13 comprises a plurality of diodes which are operably connected together on a plurality of panels, so that heat molecules are carried away from one side of the solid state semi-conductor interface or substrate into the adjacent surface of a convection enclosure or tunnel 14. The tunnel includes a plurality of graphite composite material stages, such as represented by numeral 15. A power source 16 is connected to the respective solid state interface unit 13. Each diode in the array removes a small amount of heat from where the heat source comes into contact therewith and conducts the heat to its opposite surface, thereby pulling heat energy away from the heat source and depositing the heat energy into the interior of the tunnel or enclosure 14. Heat picked up from the solid state interface 13 is transferred into the graphite composite material 15 and follows a circular path as indicated by the arrows, such as arrow 17. Heat energy along this path will enter the interior of the tunnel or enclosure, as identified by numeral 18, from the inside surface of the respective graphite composite member stages, and such transfer of heat radiation is indicated, such as by arrow 20. A fan or blower means is indicated by numeral 21 and drives or forces the heat energy derived from the graphite composite material stages through the interior of the tunnel or enclosure 14 for exhaust from the opposite end. The graphite material is thermally directional, allowing the heat being brought to the tunnel or enclosure to swirl in a circular pattern through the interior of the graphite composite material stages, where it is swept away through the passageway 18 of the tunnel or enclosure by the forced air being pushed through by the fan or blower means 21.

Figure 2:
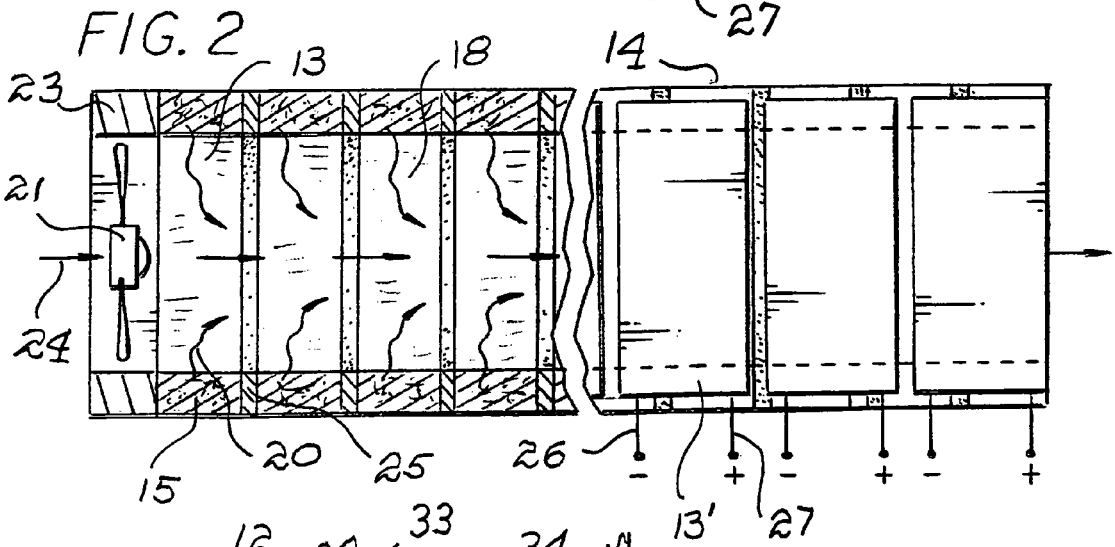
FIG. 2 is an enlarged, longitudinal drawing of the thermal electric solid state thermal management system which employs graphite composite material forming a convection rectangular tube enclosure or tunnel for evacuating the heat into ambient environment or for other purposes.

As illustrated in FIG. 2, it can be seen that the fan or blower means 21 is incorporated into a frame 23 at one end of the tunnel or enclosure 14. The fan or blower means 21 draws ambient air through an open end of the passageway 18 within the tunnel or enclosure, and the incoming air is indicated by numeral 24. It can also be seen that each of the respective graphite composite material stages 15 are separated by an insulator 25, having a central opening so there is no interference with the flow of air 24 through the interior of the tunnel or enclosure 14. Also, it can be seen that the respective solid state interface panels 13 are arranged along the sides of the tunnel or enclosure. Numeral 13 shows such an array panel on one side of the tunnel, while numeral 13' illustrates an array of panels on the other side of the tunnel or enclosure. All diodes within each of the respective arrays are coupled to the power source via the positive and negative terminals. A representative terminal for negative supply is indicated by numeral 26, while numeral 27 illustrates a positive connection to the power source.

Figure 3:
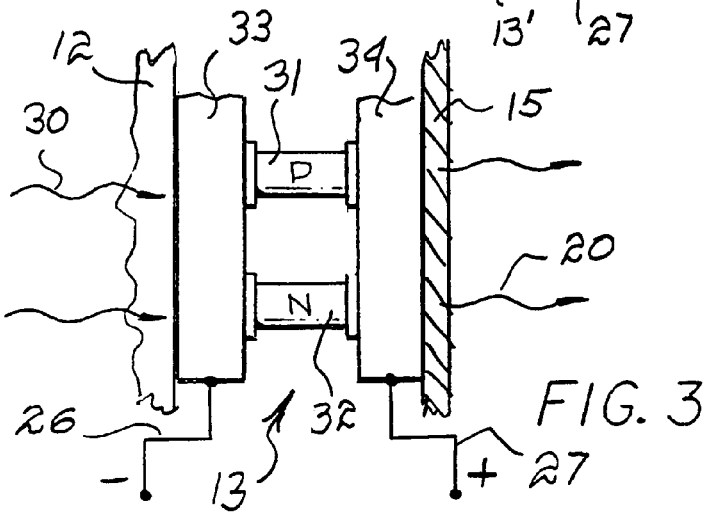
FIG. 3 is a greatly enlarged fragmentary, sectional view illustrating the interface of a solid state diode array disposed between thermal cable and the graphite composite material used in the embodiment shown in FIG. 2.

Referring now in detail to FIG. 3, it can be seen that a heat load, represented by numeral 30, is introduced to the solid state array by thermal conductors 12. The solid state array, indicated by arrow 13, includes a plurality of diodes, wherein diode 31 represents positive and diode 32 represents negative. The opposite ends of the respective diodes are connected to conductor plates 33 and 34 respectively, which in turn interface with the opposing surface of thermal conductor 12 and the opposing surface of graphite composite material stage 15. Arrow 20 represents the passage of heat into the interior of the tunnel or enclosure 14.

It is to be understood that any number of panels or array of diodes may be placed along the length of the tunnel or enclosure 14 and that each of the arrays may contain a desired plurality of positive and negative diodes.

Accordingly, the problems with conventional heat dissipation surfaces or devices are avoided by the present invention, whereby heat energy is derived from the heat source and conducted to the diode interface by means of the thermal conductor. Graphite composite material is provided in a series of stages along the length of the tunnel or enclosure, and these stages of graphite composite material support the solid state arrays 13. Heat molecules are carried away to one side of the solid state semi-conductor panel or substrate which when energized pumps heat into the adjacent surface of the convection tube enclosure via the graphite composite material, where the fan or blower means 14 blows air for evacuating the heat through the internal part of the tunnel or enclosure into the environment or for other purposes. Each diode in the array removes a small amount of heat from where the heat source touches the panel via the thermal conductor, and the heat is conducted through its opposite surface, thereby pulling heat away from the heat source. The graphite material in the respective stages is thermally directional, allowing the heat being brought to the tunnel or enclosure to swirl in a circular path, whereby it is swept away through the internal part of the tunnel or enclosure by the ambient air being pushed there through by the fan or blower means 14.

Therefore, the present invention is of solid state construction eliminating the need for refrigerants, gasses or the like. Additionally, the normally high cost of pumping refrigerant through a compressor is eliminated and the use of a compressor is eliminated altogether. The present invention is extremely light in weight because of the non-use of copper and because the compressor is not employed. Additionally, significant lower current is provided to power the diode arrays. Finally, the present invention is finitely controllable so that the device can regulate the power to the thermal semi-conductor interface 13, in combination with the fan 14, which can also be finitely regulated by the amount of power provided to it. The delta defined by the thermal control setting is controlled by the user of this new refrigeration system.

While particular embodiments of the present invention have been shown and described, it will be obvious to those skilled in the art that changes and modifications may be made without departing from this invention in its broader aspects and, therefore, the aim in the appended claims is to cover all such changes and modifications as fall within the true spirit and scope of this invention.

What is claimed is:

1. A solid state thermal apparatus for dissipating heat from a heat source, the apparatus comprising:

a multi-stage directional heat transferring enclosure having an open-ended passageway, the passageway defining first and second ends, each of said stages separated by an insulator;

a plurality of solid state devices thermally coupled to said heat source and said heat transferring enclosure, at least one said solid state device associated with a stage of said heat transferring enclosure for conductive transfer of heat energy from said solid state devices into said open ended passageway; and a blower disposed at the first end of said passageway forcing heat energy into and through said passageway to the second end of the passageway.

2. The solid state thermal apparatus defined in claim 1 wherein:

said first end of said passageway is an inlet and said second end of said passageway is an exhaust exit; and said blower is disposed in said inlet and heat energy is forced through said exhausting exit.

3. The solid state thermal apparatus defined in claim 1 wherein:

said solid state devices include a plurality of diode arrays.

4. The solid state thermal apparatus defined in claim 3 wherein:

said plurality of stages is comprised of a plurality of panels on which the plurality of diodes are operably connected.

5. The solid state thermal apparatus defined in claim 4 wherein:

each of said stages is composed of a carbon graphite composition having a high rate of thermal conductivity.

6. The solid state thermal apparatus defined in claim 3 including:

a power source operably coupled to said diode arrays by positive and negative terminals on said diode arrays.

7. The solid state thermal apparatus defined in claim 6 including:

a pair of conductor plates, each of said diode arrays connected between said pair of conductor plates; and said positive and negative terminals connected to each of said pair of conductor plates respectively.

8. A solid state thermal apparatus which comprises:

a multistage, directional heat transferring enclosure defining an open-ended passageway and a plurality of successive heat transference stages, each stage insulated from each other;

an array of panels, each panel carrying a plurality of diodes and the plurality of diodes thermally coupled to said heat source, the array of panels carried on the exterior of said heat transferring enclosure and disposed immediately adjacent to a respective heat transference stage for conducting heat energy from said array of panels to said heat transference stages for conductive transfer of heat energy into said open-ended passageway;

9. The solid state thermal apparatus defined in claim 8 wherein:

said passageway includes an inlet and an outlet with a blower mounted in said inlet for forcing a flow of ambient air through said passageway and exhausting collected heat energy via said outlet.

10. The solid state thermal apparatus defined in claim 8 wherein:

each of said heat transference stages is composed of carbon graphite composition having a high rate of thermal conductivity.

11. The solid state thermal apparatus defined in claim 8 including:

a power source operably connected to said diodes.

12. The solid state thermal apparatus defined in claim 8 further comprising:

a thermal cable that couples said array of panels with said heat source.

13. The solid state thermal apparatus defined in claim 12 wherein:

each of said diodes is a ceramic quartz diode; and said graphite material is heat conductive directional.

14. The solid state thermal apparatus defined in claim 1 wherein: the plurality of stages are arranged in a stacked arrangement.

15. The solid state thermal apparatus defined in claim 5 wherein: said carbon graphite composition is heat conductive directional.

16. A solid state thermal apparatus for dissipating heat from a heat source, the apparatus comprising:

an array of panels thermally coupled with said heat source with each panel carrying a plurality of ceramic quartz diodes;

a thermal cable having a plurality of parallel paths carried on a flexible cable, the thermal cable coupling the heat source with the array of panels;

a multi-stage directional heat transferring enclosure having an open-ended passageway and a plurality of heat transference stages insulated from each other, said heat transference stages composed of carbon graphite composition having a high rate of thermal conductivity and being heat conductive directional;

said array of panels carried on heat transferring enclosure, each panel disposed immediately adjacent to a respective heat transference stage for conducting heat energy from said panels to said heat transference stages for conductive transfer of heat energy into said open-ended passageway, each panel includes a multiplicity of diodes for conducting heat energy by pulling heat energy from said heat source; and a power source operably connected to said diodes.

* * * * *